US007172446B1

(12) United States Patent
Hashimoto et al.

(10) Patent No.: US 7,172,446 B1
(45) Date of Patent: Feb. 6, 2007

(54) ELECTRICAL CONNECTOR

(75) Inventors: Yoshimitsu Hashimoto, Machida (JP); Jin Tateishi, Machida (JP)

(73) Assignee: I-Pex Co., Ltd., Tokyo (JP)

( * ) Notice: Subject to any disclaimer, the term of this patent is extended or adjusted under 35 U.S.C. 154(b) by 0 days.

(21) Appl. No.: 11/471,492

(22) Filed: Jun. 21, 2006

(30) Foreign Application Priority Data

Aug. 25, 2005 (JP) ..... 2005-243537

(51) Int. Cl.
*H01R 13/15* (2006.01)
*H01R 13/62* (2006.01)

(52) U.S. Cl. ..... 439/260; 439/495

(58) Field of Classification Search ..... 439/260, 439/261, 494, 495, 496
See application file for complete search history.

(56) References Cited

U.S. PATENT DOCUMENTS 6,767,233 B2 * 7/2004 Tsunematsu ..... 439/260
7,083,454 B2 * 8/2006 Suzuki ..... 439/260
7,086,884 B2 * 8/2006 Okano ..... 439/260

FOREIGN PATENT DOCUMENTS

JP 2002-270290 9/2002
JP 2004-342426 12/2004

* cited by examiner

*Primary Examiner*—Hae Moon Hyeon
(74) *Attorney, Agent, or Firm*—Nixon Peabody; Donald R. Studebaker

(57) ABSTRACT

An electrical connector comprising a housing made of insulator, conductive contacts arranged in the housing and an actuator attached rotatably to the housing, wherein the conductive contacts are divided into at least first and second groups, and the actuator brings each of the conductive contacts belonging to the first group into press-contact with one of connecting terminals on a circuit board partially inserted into the housing in a first predetermined manner and each of the conductive contacts belonging to the second group into press-contact with another of the connecting terminals in a second predetermined manner different from the first predetermined manner so that a time difference is brought about between a first time point at which the conductive contacts belonging to the first group exert the maximum retroactive force to the actuator and a second time point at which the conductive contacts belonging to the second group exert the maximum retroactive force to the actuator.

7 Claims, 10 Drawing Sheets

ELECTRICAL CONNECTOR

BACKGROUND OF THE INVENTION

1. Field of the Invention

The present invention relates generally to an electrical connector, and more particularly to an improvement in an electrical connector used for putting connecting terminals provided on a circuit board, such as a flexible printed circuit board (FPC), conductors provided in a flexible flat cable assembly (FFC) or the like in electrical connection with other electrical parts, such as a main solid circuit board.

2. Description of the Prior Art

In the field of electronic apparatus including various portable telephones, a relatively small-sized flexible printed circuit board or flexible flat cable assembly is often mounted on a main printed circuit board, on which various electrical parts are directly mounted, by means of an electrical connector which is fixed to and connected electrically with the main printed circuit board. The electrical connector has a plurality of conductive contacts for coming into contact with connecting terminals provided on the flexible printed circuit board or conductors in the flexible flat cable assembly and is operative to connect, through the conductive contacts, the connecting terminals provided with the flexible printed circuit board or the conductors in the flexible flat cable assembly with conducting circuit pattern portions formed on the main printed circuit board.

For example, a previously proposed electrical connector, which is used for mounting a flexible printed circuit board on a main printed circuit board, is provided with a housing made of insulator which has an opening through which the flexible printed circuit board is partially inserted into the housing. In the housing, a plurality of conductive contacts are arranged along the opening. These conductive contacts are operative to come into contact with a plurality of connecting terminals provided on the flexible printed circuit board when the flexible printed circuit board is partially inserted into the housing through the opening. The electrical connector is further provided with an actuator which is attached rotatably to the housing to be common to the conductive contacts arranged in the housing. When the actuator is rotated in regard to the housing, each of the conductive contacts is partially moved in the housing.

Each of the conductive contacts arranged in the housing is made of conductive resilient material to have a fixed portion which is fixed to the housing and a movable portion coupled with the fixed portion. The fixed portion of the contact is connected electrically with a conducting circuit pattern portion provided on the main printed circuit board. The movable portion of the conductive contact constitutes an operating part which is moved by the actuator.

In the previously proposed electrical connector as mentioned above, when the flexible printed circuit board is partially inserted into the housing through the opening provided thereon and the actuator is rotated in a predetermined direction, the actuator operates to move the movable portion of each of the conductive contacts to come into press-contact with a corresponding one of the connecting terminals provided on the flexible printed circuit board, as shown in, for example, the Japanese patent application published before examination under publication number 2002-270290 (Publication document 1). Then, when the actuator by which the operating part of each of the conductive contacts is brought into press-contact with the corresponding connecting terminal provided on the flexible printed circuit board is rotated in a direction opposite to the predetermined direction, the movable portion of each of the conductive contacts is allowed by the actuator to move for getting out of press-contact with the corresponding connecting terminal provided on the flexible printed circuit board.

In such an electrical connector as shown in the published document 1, each of the conductive contacts is formed into an H-shaped member. The H-shaped member has a pair of beams coupled with each other through a connecting portion. One of the beams constitutes the fixed portion of the conductive contact and the other of the beams constitutes the movable portion, namely, the operating part of the conductive contact. When the flexible printed circuit board is partially inserted into the housing through the opening provided thereon, a portion of the flexible printed circuit board, on which the connecting terminals are provided, is placed between the fixed and movable portions of each of the conductive contacts. When the actuator is rotated for moving the movable portion of each of the conductive contacts to come into press-contact with the corresponding connecting terminal provided on the flexible printed circuit board, the portion of the flexible printed circuit board, on which the connecting terminals are provided, is held between the fixed portion of each of the conductive contacts and the movable portion of each of the conductive contacts which is brought into press-contact with the corresponding connecting terminal.

Further, there has been another type of the previously proposed electrical connector which is provided with a housing having an opening through which a flexible printed circuit board is partially inserted into the housing, a plurality of conductive contacts arranged along the opening on the housing and an actuator attached rotatably to the housing in almost the same manner as those of the electrical connector shown in the publication document 1, and in which the conductive contacts, each of which is formed into an H-shaped member having fixed and movable portions coupled with each other through a connecting portion, are divided into first and second groups, as shown in, for example, the Japanese patent application published before examination under publication number 2004-342426 (Published document 2).

In the electrical connector as shown in the published document 2, the movable portion of each of the conductive contacts belonging to the first group and the movable portion of each of the conductive contacts belonging to the second group are different in length from each other. When the flexible printed circuit board is partially inserted into the housing through the opening provided thereon and the actuator is rotated for moving the movable portion of each of the conductive contacts belonging to the first and second groups to come into press-contact with the corresponding connecting terminal provided on the flexible printed circuit board, a distance from an end of the connecting terminal which corresponds to the conductive contact belonging to the first group to a portion of that connecting terminal with which the conductive contact belonging to the first group comes into press-contact is different from a distance from an end of the connecting terminal which corresponds to the conductive contact belonging to the second group to a portion of that connecting terminal with which the conductive contact belonging to the second group comes into press-contact. The conductive contacts belonging to the first group and the conductive contacts belonging to the second group are arranged alternately.

In the electrical connector thus proposed previously to be used for mounting the flexible printed circuit board on the main printed circuit board, when the flexible printed circuit board is partially inserted into the housing through the opening provided thereon and the actuator is rotated in the predetermined direction for moving the movable portion of each of the conductive contacts to come into press-contact with the corresponding connecting terminal provided on the flexible printed circuit board, the actuator operates to move the movable portions of the conductive contacts at the same time so that all movable portions of the conductive contacts come simultaneously into press-contact with the connecting terminals provided on the flexible printed circuit board and therefore retroactive force from all movable portions of the conductive contacts acts simultaneously on the actuator.

The amount of the retroactive force from all movable portions of the conductive contacts reaches the maximum value when the movement of the movable portion of each of the conductive contacts is at the maximum. This maximum value of the amount of the retroactive force from all movable portions of the conductive contacts is relatively large because each of the conductive contacts is made of resilient material. In the case where a large number of the conductive contacts are provided in the housing, as disclosed in the publication document 1 or 2, an especially large amount of the retroactive force from all movable portions of the conductive contacts acts on the actuator.

It has been usual that the actuator has a relatively small dimension in a direction perpendicular to a rotating axis extending along the arrangement of the conductive contacts compared with a dimension in the direction of the rotating axis so that the height on the actuator on the main printed circuit board is restrained at the minimum when the actuator is caused to rise from the housing.

Consequently, an operation for rotating the actuator becomes heavy and a relatively large force is necessary for rotating the actuator. This results in a disadvantage that the actuator is inferior in its operational easiness. In addition, it is feared that the actuator which is inferior in its operational easiness is damaged with an excessive force acted on the actuator for rotating the same coercively.

OBJECTS AND SUMMARY OF THE INVENTION

Accordingly, it is an object of the present invention to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator attached rotatably to the housing to engage with each of the conductive contacts and operative to move a movable portion of each of the conductive contacts when the actuator is rotated in regard to the housing, and which avoids the aforementioned disadvantages encountered with the prior art.

Another object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator attached rotatably to the housing to engage with each of the conductive contacts and operative to move a movable portion of each of the conductive contacts when the actuator is rotated in regard to the housing, and in which the actuator is improved in its operational easiness.

A further object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator attached rotatably to the housing to engage with each of the conductive contacts and operative to move a movable portion of each of the conductive contacts when the actuator is rotated in regard to the housing, and in which the actuator is effectively prevented from being damaged with an excessive force acted thereon.

A still further object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator attached rotatably to the housing to engage with each of the conductive contacts and operative to move a movable portion of each of the conductive contacts when the actuator is rotated in regard to the housing, and in which an operational force necessary for rotating the actuator is advantageously reduced.

According to the present invention, as claimed in any one of claims, there is provided an electrical connector, which comprises a housing made of insulator and provided with an opening through which a circuit board is partially inserted into the housing, a plurality of conductive contacts arranged in the housing, each of which is positioned to correspond to one of a plurality of connecting terminals provided on the circuit board when the circuit board is partially inserted into the housing through the opening provided thereon, and an actuator attached rotatably to the housing to engage with the conductive contacts and to take up first and second stations selectively for bringing each of the conductive contacts into press-contact with one of the connecting terminals corresponding thereto when the circuit board is partially inserted into the housing through the opening provided thereon and the actuator is shifted from the first station to the second station and for causing each of the conductive contacts to get out of press-contact with the corresponding one of the connecting terminals when the circuit board is partially inserted into the housing through the opening provided thereon and the actuator is shifted from the second station to the first station, wherein the conductive contacts provided in the housing are divided into at least first and second groups, and the actuator engages with each of the conductive contacts belonging to the first group for bringing the same into press-contact with the corresponding connecting terminal in a first predetermined manner and with each of the conductive contacts belonging to the second group for bringing the same into press-contact with the corresponding connecting terminal in a second predetermined manner different from the first predetermined manner so that a time difference is brought about between a first time point at which the conductive contacts belonging to the first group kept in press-contact with the connecting terminals exert the maximum retroactive force to the actuator and a second time point at which the conductive contacts belonging to the second group kept in press-contact with the connecting terminals exert the maximum retroactive force to the actuator.

Especially, in one embodiment of electrical connector according to the present invention, the actuator has a plurality of cams each engaging with one of the conductive contacts in the housing and operative to move a movable portion of the conductive contact to come into press-contact with the connecting terminal provided on the circuit board which is partially inserted into the housing through the opening provided thereon. With the operation of the cams, the actuator operates to bring each of the conductive contacts belonging to the first group into press-contact with the corresponding connecting terminal in the first predetermined manner and each of the conductive contacts belonging to the second group into press-contact with the corresponding connecting terminal in the second predetermined manner different from the first predetermined manner.

In the electrical connector thus constituted in accordance with the present invention, when the circuit board, such as a flexible printed circuit board, is partially inserted into the housing through the opening provided thereon and the actuator is rotated to move from the first station toward the second station, the actuator in the movement from the first station toward the second station operates to bring each of the conductive contacts arranged in the housing into press-contact with one of the connecting terminals provided on the circuit board corresponding thereto, for example, by causing the cams to move the movable portion of each of the conductive contacts. After that, when the actuator is rotated to move from the second station toward the first station, the actuator in the movement from the second station toward the first station operates to cause each of the conductive contacts to get out of press-contact with the corresponding one of the connecting terminals, for example, by causing the cams to move the movable portion of each of the conductive contacts.

In such operations, the actuator in the movement from the first station toward the second station operates, for example, with the operation of the cams engaging with the conductive contacts, to bring each of the conductive contacts belonging to the first group into press-contact with the corresponding connecting terminal in the first predetermined manner and each of the conductive contacts belonging to the second group into press-contact with the corresponding connecting terminal in the second predetermined manner different from the first predetermined manner so that the time difference is brought about between the first time point at which the conductive contacts belonging to the first group kept in press-contact with the connecting terminals exert the maximum retroactive force to the actuator and the second time point at which the conductive contacts belonging to the second group kept in press-contact with the connecting terminals exert the maximum retroactive force to the actuator. In other words, the actuator does not operate to cause both of the conductive contacts belonging to the first group and the conductive contacts belonging to the second group to exert the maximum retroactive force on the actuator simultaneously, but operates first to cause the conductive contacts belonging to the first group to exert the maximum retroactive force on the actuator and then to cause the conductive contacts belonging to the second group to exert the maximum retroactive force on the actuator. The maximum retroactive force exerted on the actuator by the conductive contacts belonging to the first or second group is brought about in a condition in which the movable portion of each of the conductive contacts is moved at the maximum by the actuator.

With the electrical connector thus constituted in accordance with the present invention, when the actuator is rotated to move from the first station toward the second station so as to operate, for example, with the operation of the cams engaging with the conductive contacts arranged in the housing to move the movable portion of each of the conductive contacts, to bring each of the conductive contacts into press-contact with the corresponding one of the connecting terminals provided on the circuit board which is partially inserted into the housing through the opening provided thereon, the retroactive force from the conductive contacts, for example, the retroactive force from the movable portion of each of the conductive contacts, acts on the actuator as reaction against the rotation of the actuator. Accordingly, an operational force which is able to overcome the maximum retroactive force from the conductive contacts acting on the actuator is necessary for rotating the actuator.

Under such a condition, the actuator in the rotation to move from the first station toward the second station operates to bring about the time difference between the first time point at which the conductive contacts belonging to the first group kept in press-contact with the connecting terminals exert the maximum retroactive force to the actuator and the second time point at which the conductive contacts belonging to the second group kept in press-contact with the connecting terminals exert the maximum retroactive force to the actuator, so that first the conductive contacts belonging to the first group are caused to exert the maximum retroactive force on the actuator and then the conductive contacts belonging to the second group are caused to exert the maximum retroactive force on the actuator. Consequently, when each of the conductive contacts is brought into press-contact with the corresponding one of the connecting terminals by the actuator, the maximum retroactive force from the conductive contacts belonging to the first group and the maximum retroactive force from the conductive contacts belonging to the second group act on the actuator respectively with the time difference. For example, after the maximum retroactive force from the conductive contacts belonging to the first group has acted on the actuator, the maximum retroactive force from the conductive contacts belonging to the second group acts on the actuator.

Each of the maximum retroactive force from the conductive contacts belonging to the first group and the maximum retroactive force from the conductive contacts belonging to the second group is evidently smaller than the amount of the retroactive force from all conductive contacts which are divided into at least the first and second groups and substantially equal to the value obtained by means of dividing the amount of the retroactive forces from all conductive contacts by the number of the groups of the conductive contacts. Therefore, the maximum retroactive force acting on the actuator at the same time is reduced to be equal to or less than a half of the amount of the retroactive force from all conductive contacts.

As described above, in the electrical connector according to the present invention, when the actuator attached rotatably to the housing is rotated to bring each of the conductive contacts arranged in the housing into press-contact with one of the connecting terminals provided on the circuit board which is partially inserted into the housing through the opening provided thereon, the maximum retroactive force from the conductive contacts acting on the actuator as reaction against the rotation of the actuator is restrained to be relatively small. Therefore, a relatively small operational force which is able to overcome the maximum retroactive force from the conductive contacts which is restrained to be relatively small is necessitated for rotating the actuator.

Consequently, with the electrical connector according to the present invention, the operational force necessary for rotating the actuator is advantageously reduced, so that the actuator is effectively prevented from being damaged with an excessive force acted thereon and improved in its operational easiness.

The above, and other objects, features and advantages of the present invention will become apparent from the following detailed description taken in conjunction with the accompanying drawings.

DESCRIPTION OF THE PREFERRED EMBODIMENTS

Figure 1:
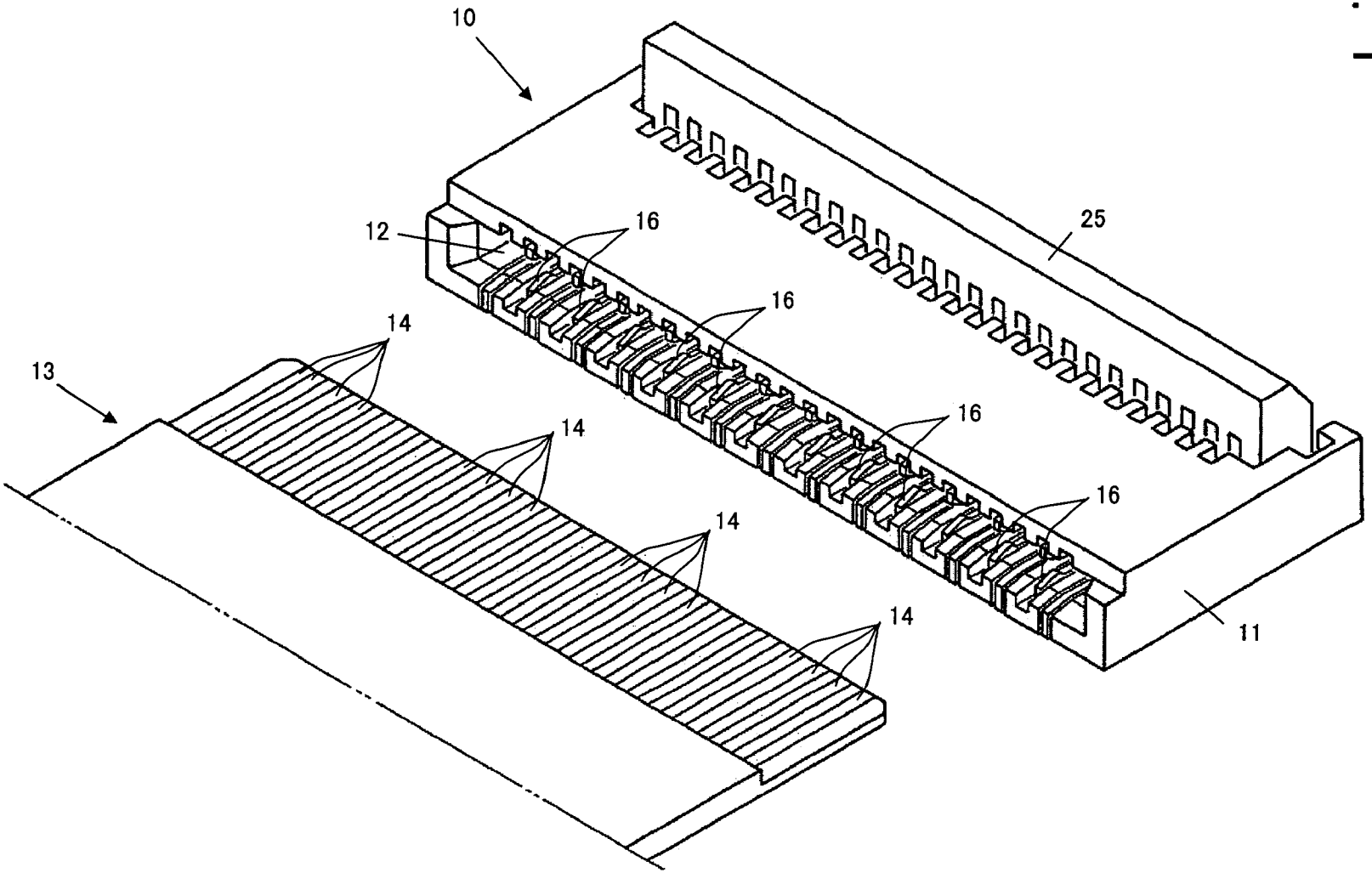
FIG. 1 is a schematic perspective view showing a first embodiment of electrical connector according to the present invention, together with a part of a flexible printed circuit board which is to be partially inserted into the first embodiment.
Figure 2:
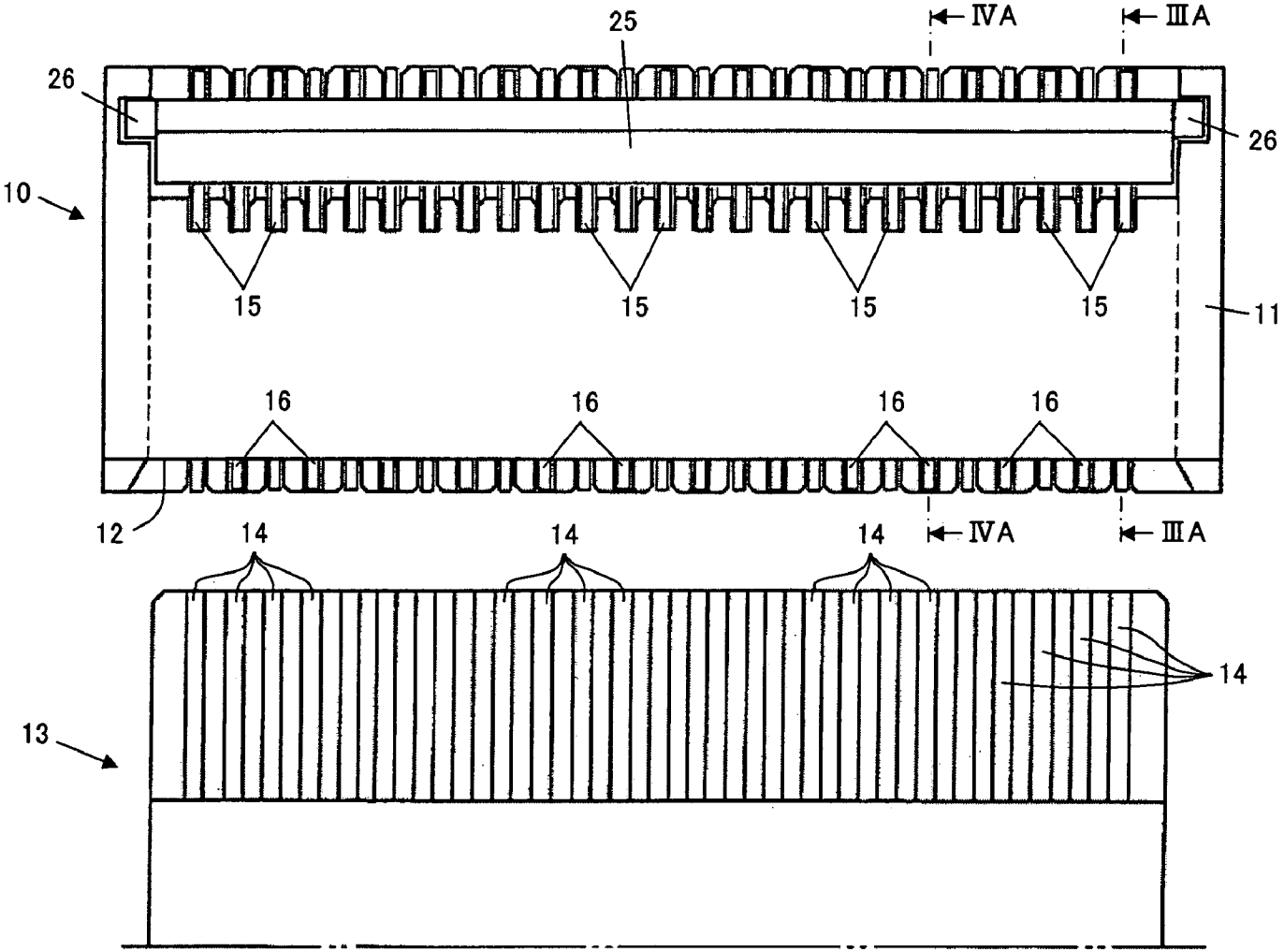
FIG. 2 is a schematic plane view showing the first embodiment shown in FIG. 1, together with the part of the flexible printed circuit board shown in FIG. 1 which is to be partially inserted into the first embodiment.

FIGS. 1 and 2 show a first embodiment of electrical connector according to the present invention, together with a part of a flexible printed circuit board which is to be partially inserted into the first embodiment.

Referring to FIGS. 1 and 2, an electrical connector 10, which constitutes the first embodiment of electrical connector according to the present invention, has a housing 11 made of insulator such as plastics or the like and provided with an opening 12 through which a circuit board is partially inserted into the housing 11. For example, a flexible printed circuit board 13 is partially inserted into the housing 11 through the opening 12. On a part of the flexible printed circuit board 13, which is inserted into the housing 11 through the opening 12, a plurality of connecting terminals 14 each made of conductive material and formed into a rectangular plate member are provided to be arranged. Each of the connecting terminals 14 is electrically connected with a conducting circuit pattern portion provided on the flexible printed circuit board 13, an illustration of which is omitted.

A plurality of conductive contacts 15 and a plurality of conductive contacts 16 are arranged alternately in the housing 11 of the electrical connector 10. Each of the conductive contacts 15 and 16 elongates in a direction along which the part of the flexible printed circuit board 13 is inserted into the housing 11 and drawn out of the housing 11 and is positioned to correspond to one of the connecting terminals 14 provided on the part of the flexible printed circuit board 13 when the flexible printed circuit board 13 is partially inserted into the housing 11 through the opening 12.

Figure 3A:
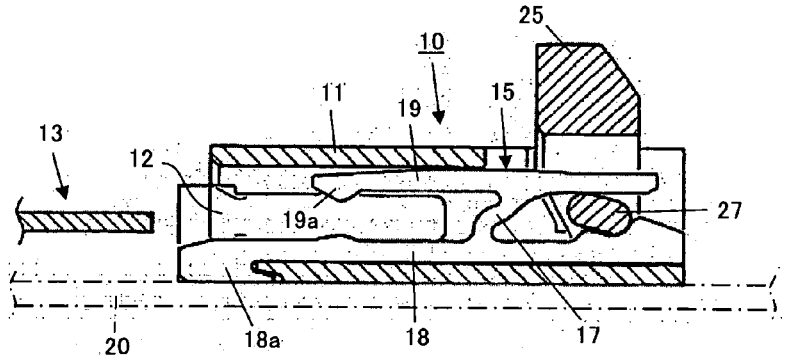
FIGS. 3A, 3B, 3C, 4A, 4B and 4C are schematic cross sectional views used for explaining the structure and operation of the first embodiment shown in FIGS. 1 and 2.

Each of the conductive contacts 15 is made of conductive resilient material and formed into an H-shaped plate member, as shown in FIG. 3A showing a cross section taken along line IIIA—IIIA in FIG. 2. The conductive contact 15 has a pair of beams 18 and 19 coupled with each other through a connecting portion 17. The beam 18 constitutes a fixed portion of the conductive contact 15 and the beam 19 constitutes a movable portion of the conductive contact 15 serving as an operating part of the conductive contact 15. An end portion 18*a* of the beam 18 is electrically connected with a conducting circuit pattern portion provided on a main circuit board 20 on which the electrical connector 10 is mounted and disposed at the opening 12 provided on the housing 11. An illustration of the conducting circuit pattern portion on the main circuit board 20 is omitted. An end portion 19*a* of the beam 19 is disposed at a position separated from the opening 12 toward the inside of the housing 11.

Figure 4A:
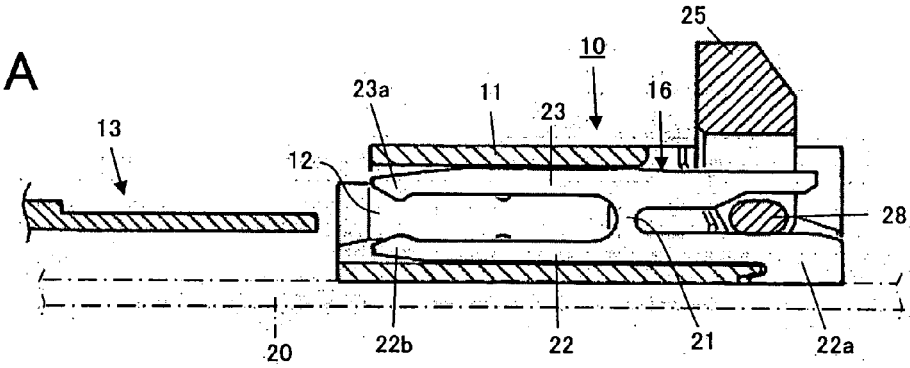

Each of the conductive contacts 16 is also made of conductive resilient material and formed into an H-shaped plate member, as shown in FIG. 4A showing a cross section taken along line IVA—IVA in FIG. 2. The conductive contact 16 has a pair of beams 22 and 23 coupled with each other through a connecting portion 21. The beam 22 constitutes a fixed portion of the conductive contact 16 and the beam 23 constitutes a movable portion of the conductive contact 16 serving as an operating part of the conductive contact 16. One end portion 22*a* of the beam 22 is electrically connected with a conducting circuit pattern portion provided on a main circuit board 20 on which the electrical connector 10 is mounted. An illustration of the conducting circuit pattern portion on the main circuit board 20 is omitted. The other end portion 22*b* of the beam 22 is disposed in the opening 12 provided on the housing 11. An end portion 23*a* of the beam 23 is also disposed in the opening 12 provided on the housing 11.

The conductive contacts 15 and the conductive contacts 16 thus arranged alternately are divided into first and second groups. The first group is formed with the conductive contacts 15 each having the beam 19, the end portion 19*a* of which is disposed at the position separated from the opening 12 toward the inside of the housing 11, and the second group is formed with the conductive contacts 16 each having the beam 23, the end portion 23*a* of which is disposed in the opening 12 provided on the housing 11. That is, each of the conductive contacts 15 belongs to the first group and each of the conductive contacts 16 belongs to the second group.

When the flexible printed circuit board 13 is partially inserted into the housing 11 through the opening 12, the part of the flexible printed circuit board 13 on which the connecting terminals 14 are provided is placed between the beam 18 and the beam 19 of each of the conductive contacts 15 and between the beam 22 and the beam 23 of each of the conductive contacts 16. The connecting terminals 14 provided on part of the flexible printed circuit board 13 are positioned to correspond respectively to the conductive contacts 15 and 16 which are arranged alternately in the housing 11.

Figure 5:
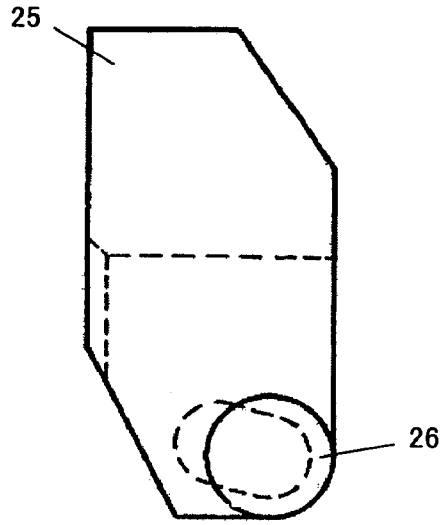
FIGS. 5, 6 and 7 are schematic cross sectional views used for explaining the structure of an actuator provided in the first embodiment shown in FIGS. 1 and 2.

Further, the electrical connector 10 has an actuator 25 which is attached rotatably to the housing 11 to be positioned at a side of the housing 11 opposite to another side of the housing 11 on which the opening 12 is provided. The actuator 25 is shaped into a long and narrow member elongating along the arrangement of the conductive contacts 15 and 16 and provided with rotary axes 26 at both its end portions in the longitudinal direction, as shown in FIGS. 2 and 5. The rotary axes 26 are engaged with a pair of bearings provided on the housing 11, respectively, so that the actuator 25 is able to rotate in regard to the housing 11.

The actuator 25 is postured to take up first and second stations selectively. In the first station, the actuator 25 keeps rising from the housing 11, as shown in FIGS. 1, 2, 3A and 4A, and in the second station, the actuator 25 keeps lying down on the housing 11, as shown in FIGS. 3C, 4C and 8 to 10. Then, the actuator 25 is rotated to shift from the first station to the second station or from the second station to the first station.

Figure 6:
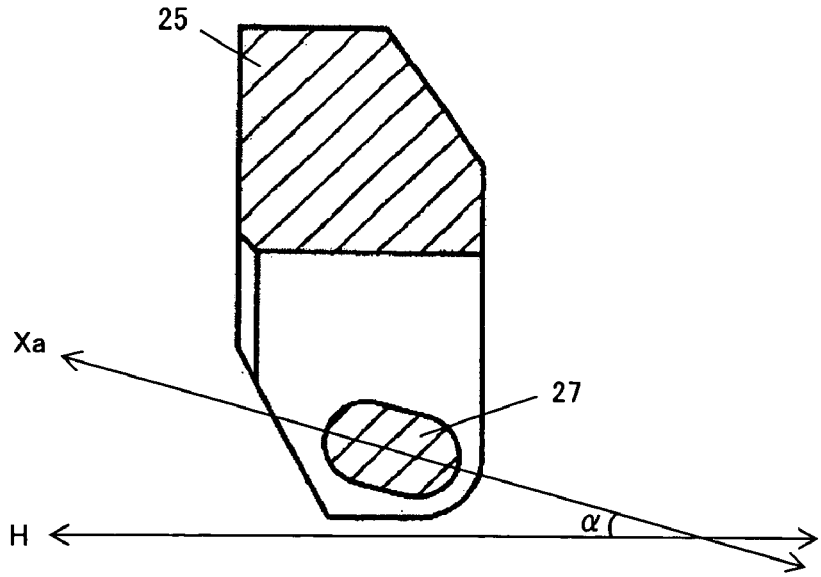

The actuator 25 has a plurality of cams 27 each engaging with one of the conductive contacts 15, as shown in FIG. 3A. Each of the cams 27 has an oval cross section, as shown in FIGS. 3A and 6. The oval cross section of the cam 27 has the maximum dimension measured across in a direction which varies with the rotation of the actuator 25. Hereinafter, this direction is referred to as a first direction of maximum dimension. The cam 27 is put between the beams 18 and 19 of the conductive contact 15 to engage with both of the beams 18 and 19.

Figure 7:
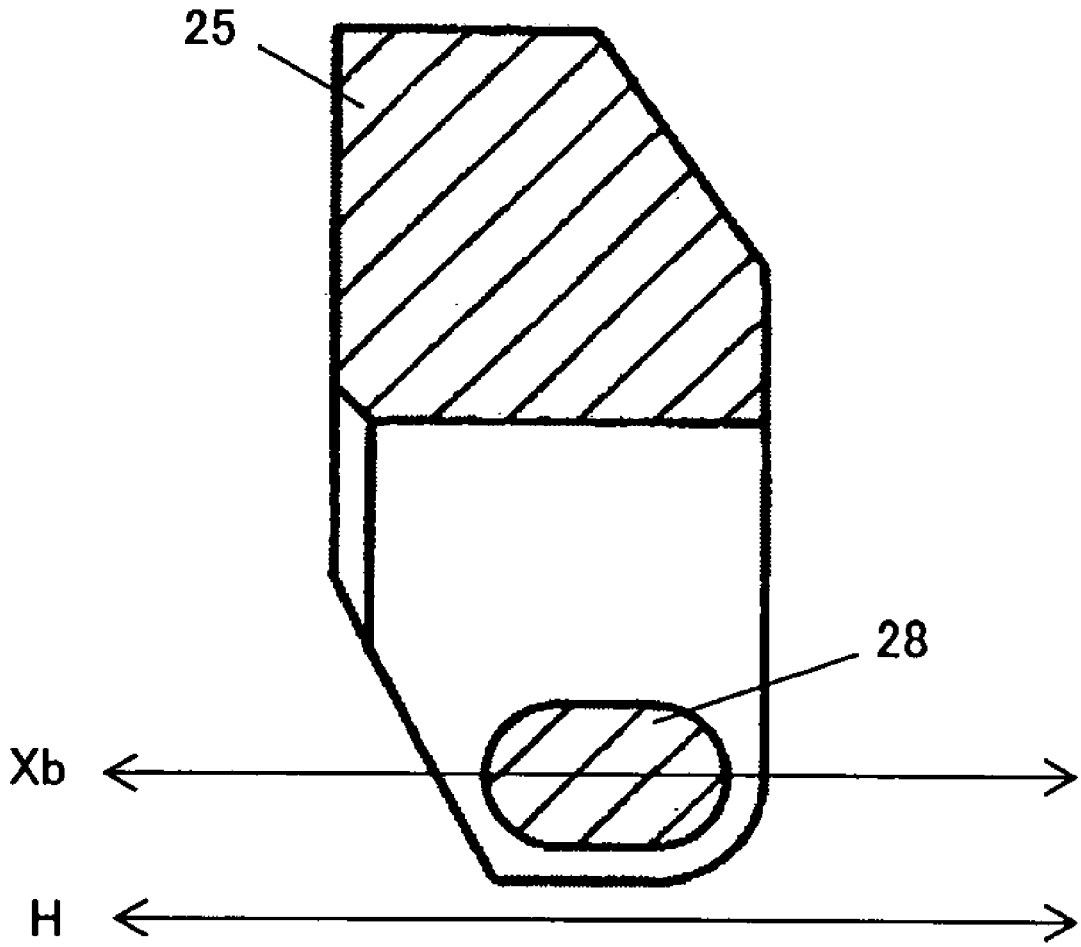
Figure 8:
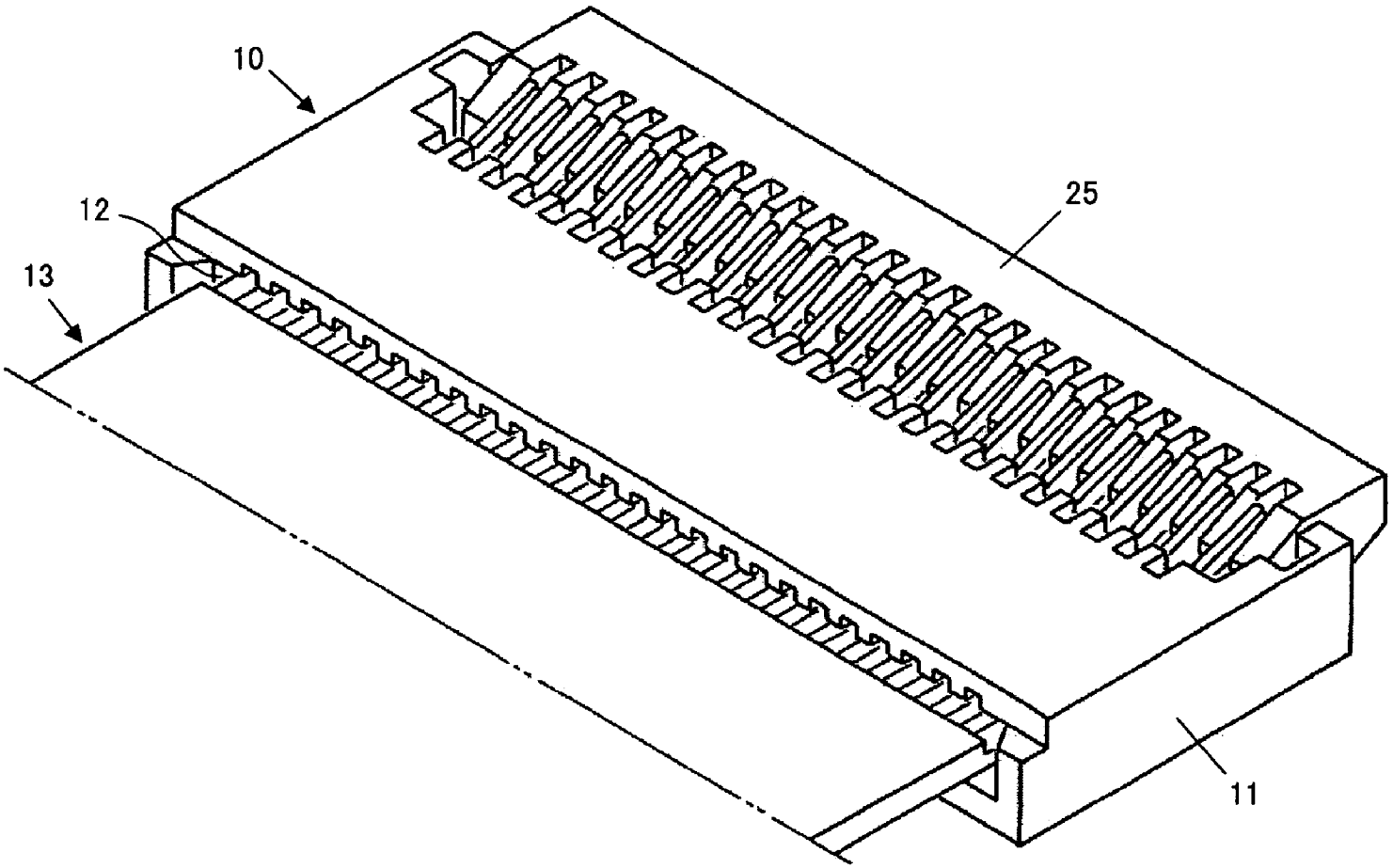
FIG. 8 is a schematic perspective view showing the first embodiment shown in FIGS. 1 and 2 into which the flexible printed circuit board shown in FIGS. 1 and 2 is partially inserted and in which the actuator has been rotated.
Figure 9:
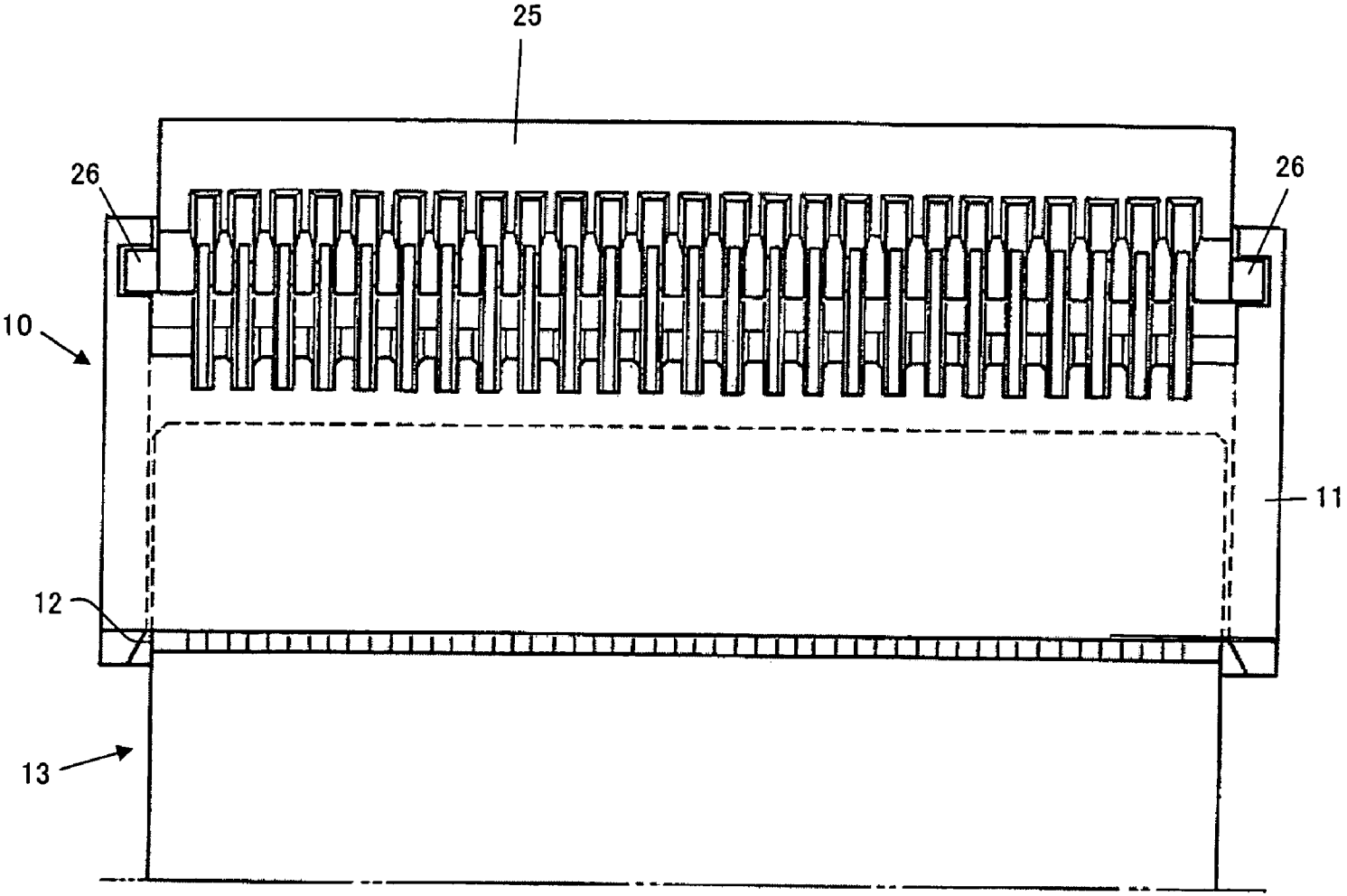
FIG. 9 is a schematic plane view showing the first embodiment shown in FIGS. 1 and 2 into which the flexible printed circuit board shown in FIGS. 1 and 2 is partially inserted and in which the actuator has been rotated.

The actuator 25 has also a plurality of cams 28 each engaging with one of the conductive contacts 16, as shown in FIG. 4A, in addition to the cams 27. Each of the cams 28 has an oval cross section in the same manner as the cam 27, as shown in FIGS. 4A and 7. The oval cross section of the cam 28 has the maximum dimension measured across in a direction which varies with the rotation of the actuator 25. Hereinafter, this direction is referred to as a second direction of maximum dimension. The cam 28 is put between the beams 22 and 23 of the conductive contact 16 to engage with both of the beams 22 and 23.

Since the conductive contacts 15 and the conductive contacts 16 are arranged alternately in the housing 11, the cams 27 and the cams 28 are also arranged alternately on the actuator 25 in the longitudinal direction of the same. The first direction of maximum dimension of each of the cams 27 is different from the second direction of maximum dimension of each of the cams 28. For example, when the actuator 25 is postured to take up the first station, the first direction of maximum dimension of each of the cams 27 slants to a direction parallel with a plane of the main circuit board 20, as shown in FIG. 3A, and the second direction of maximum dimension of each of the cams 28 is substantially parallel with the direction parallel with the plane of the main circuit board 20, as shown in FIG. 4A.

In more detail, on the other hand, as shown in FIG. 6 in which Xa indicates the first direction of maximum dimension of the cams 27 and H indicates the direction parallel with the plane of the main circuit board 20, for example, when the actuator 25 is postured to take up the first station, the first direction of maximum dimension of the cams 27 (Xa) is at the angle of $\alpha$ to the direction parallel with the plane of the main circuit board 20 (H). On the other hand, as shown in FIG. 7 in which Xb indicates the second direction of maximum dimension of the cams 28 and H indicates the direction parallel with the plane of the main circuit board 20, for example, when the actuator 25 is postured to take up the first station, the second direction of maximum dimension of the cams 28 (Xb) is substantially parallel with the direction parallel with the plane of the main circuit board 20 (H). Accordingly, there is an angular difference of $\alpha$ between the first direction of maximum dimension of the cams 27 (Xa) and the second direction of maximum dimension of the cams 28 (Xb).

Under such a situation, when the flexible printed circuit board 13 is partially inserted into the housing 11 through the opening 12 and the actuator 25 is rotated to shift from the first station to the second station, each of the conductive contacts 15 and 16 is brought into press-contact with one of the connecting terminals 14 provided on the part of the flexible printed circuit board 13 inserted into the housing 11. In this operation, first the flexible printed circuit board 13 is partially inserted into the housing 11 through the opening 12 when the actuator 25 is postured to take up the first station. The part of the flexible printed circuit board 13 on which the connecting terminals 14 are provided is placed between the beam 18 and the beam 19 of each of the conductive contacts 15 and between the beam 22 and the beam 23 of each of the conductive contacts 16 in the housing 11. Next, the actuator 25 is rotated to move from the first station toward the second station. With the movement of the actuator 25 from the first station toward the second station, the cams 27 and the cams 28 provided alternately on the actuator 25 are rotated, so that each of the cams 27 and each of the cams 28 vary simultaneously the first direction of maximum dimension and the second direction of maximum dimension, respectively.

Figure 3B:
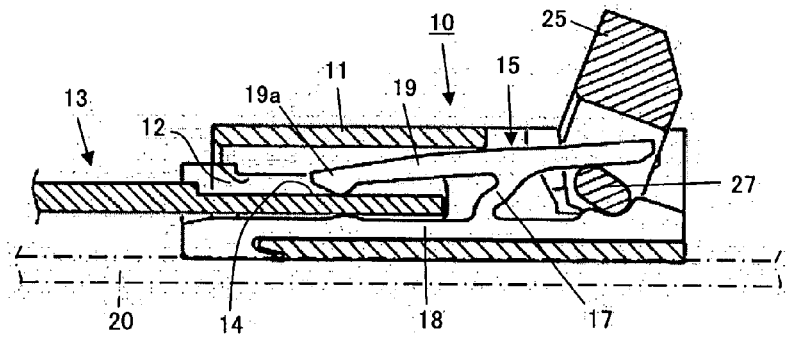

As shown in FIG. 3B, with the rotation of the actuator 25, the cam 27 engages with both of the beam 18 and the beam 19 of the conductive contact 15 with variations in the first direction of maximum dimension thereof so as to move the beam 19. Then, when a specific portion of the cam 27 having the maximum dimension measured across in its cross section or a portion of the cam 27 adjacent to the specific portion acts on the beam 19, the cam 27 operates to bring the beam 19 into press-contact with the connecting terminal 14 provided on the part of the flexible printed circuit board 13. When the beam 19 is brought into press-contact with the connecting terminal 14, the end portion 19*a* of the beam 19 comes practically into contact with the connecting terminals 14 and the part of the flexible printed circuit board 13 on which the connecting terminal 14 is provided is held by the beam 18 and the beam 19.

Figure 3C:
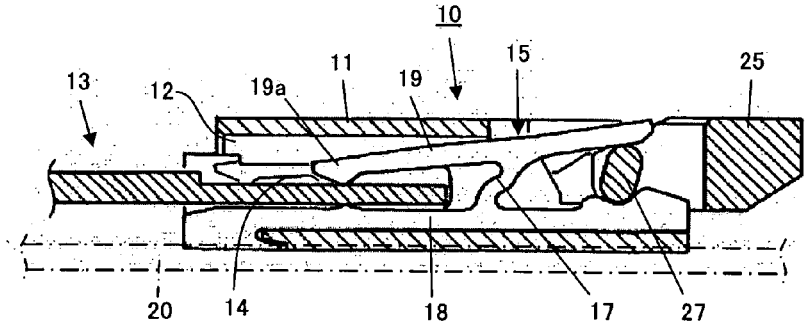

After that, the actuator 25 is further rotated to take up the second station, as shown in FIG. 3C showing a cross section taken along line IIIC—IIIC in FIG. 3C, the cam 27 causes the end portion 19*a* of the beam 19 to continue to be contact with the connecting terminal 14 so that the part of the flexible printed circuit board 13 on which the connecting terminal 14 is provided is continuously held by the beam 18 and the beam 19. Therefore, the beam 19 is continuously put in press-contact with the connecting terminal 14 provided on the part of the flexible printed circuit board 13.

In the above operations, when the specific portion of the cam 27 having the maximum dimension measured across in its cross section acts on the beam 19 of the conductive contact 15, the cam 27 moves the beam 19 at the maximum and thereby the maximum retroactive force from the beam 19 acts on the cam 27. Accordingly, a time point at which the specific portion of each of the cams 27 having the maximum dimension measured across in its cross section acts on the beam 19 of one of the conductive contacts 15 is a time point at which the conductive contacts 15 exert the maximum retroactive force on the actuator 25.

Figure 4B:
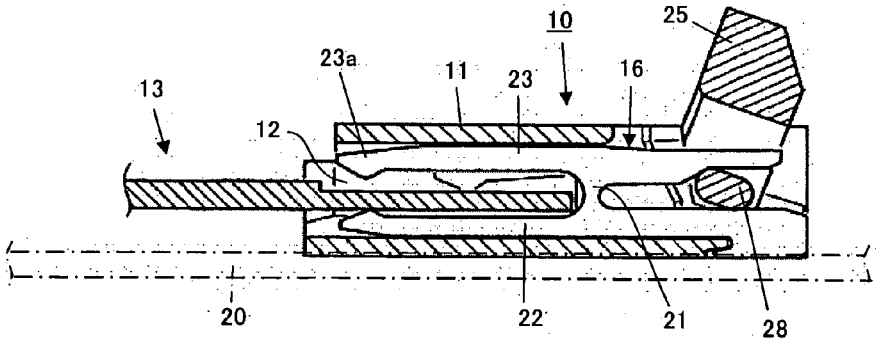
Figure 4C:
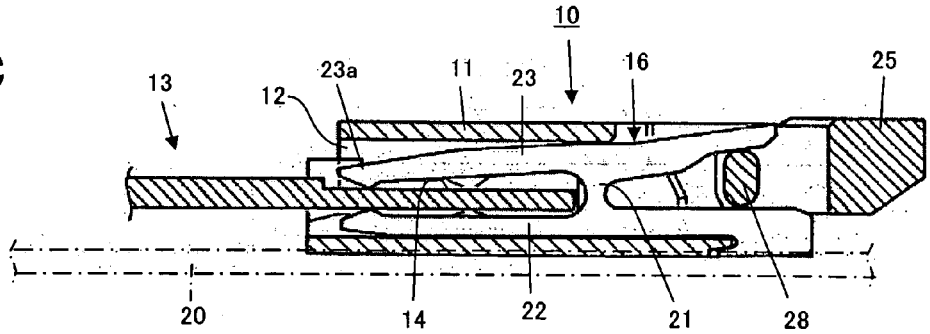

As shown in FIG. 4B, with the rotation of the actuator 25, the cam 28 engages with both of the beam 22 and the beam 23 of the conductive contact 16 with variations in the second direction of maximum dimension thereof so as to move the beam 23. Then, when a specific portion of the cam 28 having the maximum dimension measured across in its cross section acts on the beam 23, the cam 28 operates to bring the beam 23 into press-contact with the connecting terminal 14 provided on the part of the flexible printed circuit board 13, as shown in FIG. 4C showing a cross section taken along line IVC—IVC in FIG. 4C. When the beam 23 is brought into press-contact with the connecting terminal 14, the end portion 23*a* of the beam 23 comes practically into contact with the connecting terminals 14 and the part of the flexible printed circuit board 13 on which the connecting terminal 14 is provided is held by the beam 22 and the beam 23.

In the above operations, when the specific portion of the cam 28 having the maximum dimension measured across in its cross section acts on the beam 23 of the conductive contact 16, the cam 28 moves the beam 23 at the maximum and thereby the maximum retroactive force from the beam 23 acts on the cam 28. Accordingly, a time point at which the specific portion of each of the cams 28 having the maximum dimension measured across in its cross section acts on the beam 23 of one of the conductive contacts 16 is a time point at which the conductive contacts 16 exert the maximum retroactive force on the actuator 25.

The second direction of maximum dimension of each of the cams 28 is different from the first direction of maximum dimension of each of the cams 27. Therefore, during the rotation of the actuator 25 to move from the first station toward the second station, the time point at which the specific portion of each of the cams 28 having the maximum dimension measured across in its cross section acts on the beam 23 of one of the conductive contacts 16 is different from the time point at which the specific portion of each of the cams 27 having the maximum dimension measured across in its cross section acts on the beam 19 of one of the conductive contacts 15, so that a time difference is brought about between both of the time points. For example, during the rotation of the actuator 25 to move from the first station toward the second station, first the specific portion of each of the cams 27 having the maximum dimension measured across in its cross section acts on the beam 19 of one of the conductive contacts 15 and then specific portion of each of the cams 28 having the maximum dimension measured across in its cross section acts on the beam 23 of one of the conductive contacts 16.

Accordingly, a time difference is brought about between the time point at which the conductive contacts 15 exert the maximum retroactive force on the actuator 25, which is the same as the time point at which the specific portion of each of the cams 27 having the maximum dimension measured across in its cross section acts on the beam 19 of one of the conductive contacts 15, and the time point at which the conductive contacts 16 exert the maximum retroactive force on the actuator 25, which is the same as the time point at which the specific portion of each of the cams 28 having the maximum dimension measured across in its cross section acts on the beam 23 of one of the conductive contacts 16. For example, the time point at which the conductive contacts 15 exert the maximum retroactive force on the actuator 25 comes first and the time point at which the conductive contacts 16 exert the maximum retroactive force on the actuator 25 comes after that.

As described above, during the movement of the actuator 25 from the first station toward the second station for causing the cams 27 and 28 provided on the actuator 25 to bring the conductive contacts 15 and 16 into press-contact with the connecting terminals 14 provided on the part of the flexible printed circuit board 13, the actuator 25 operates to engage with each of the conductive contacts 15 belonging to the first group for bringing the same into press-contact with the corresponding connecting terminal 14 in a first predetermined manner and with each of the conductive contacts 16 belonging to the second group for bringing the same into press-contact with the corresponding connecting terminal 14 in a second predetermined manner different from the first manner so that the time difference is brought about between the time point at which the conductive contacts 15 exert the maximum retroactive force on the actuator 25 and the time point at which the conductive contacts 16 exert the maximum retroactive force on the actuator 25.

As shown in FIG. 4C, when the actuator is postured to take up the second station, the cam 28 keeps the specific portion thereof having the maximum dimension measured across in its cross section acting on the beam 23 of the conductive contact 16. Thereby, the end portion 23*a* of the beam 23 is put in contact with the connecting terminal 14 and the part of the flexible printed circuit board 13 on which the connecting terminal 14 is provided is held between the beams 22 and 23 of the conductive contact 16. That is, the beam 23 of the conductive contact 16 is continuously put in press-contact with the connecting terminal 14 provided on the part of the flexible printed circuit board 13.

The actuator 25 on which the cams 27 each engaging with the beams 18 and 19 of each of the conductive contacts 15 and the cams 28 each engaging with the beams 22 and 23 of each of the conductive contacts 16 are provided, is put selectively in a first condition at the first station and a second condition at the second station. In the first condition, a moment caused in the counterclockwise direction in FIGS. 3A and 4A by the actions of the conductive contacts 15 and 16 affected on the cams 27 and 28 acts on the actuator 25 which is postured to take up the first station, as shown in FIGS. 3A and 4A. In the second condition, a moment caused in the clockwise direction in FIGS. 3C and 4C by the actions of the conductive contacts 15 and 16 affected on the cams 27 and 28 acts on the actuator 25 which is postured to take up the second station, as shown in FIGS. 3C and 4C. Consequently, the actuator 25 at the first station is caused to keep its posture for taking up the first station and the actuator 25 at the second station is caused to keep its posture for taking up the second station.

Figure 10:
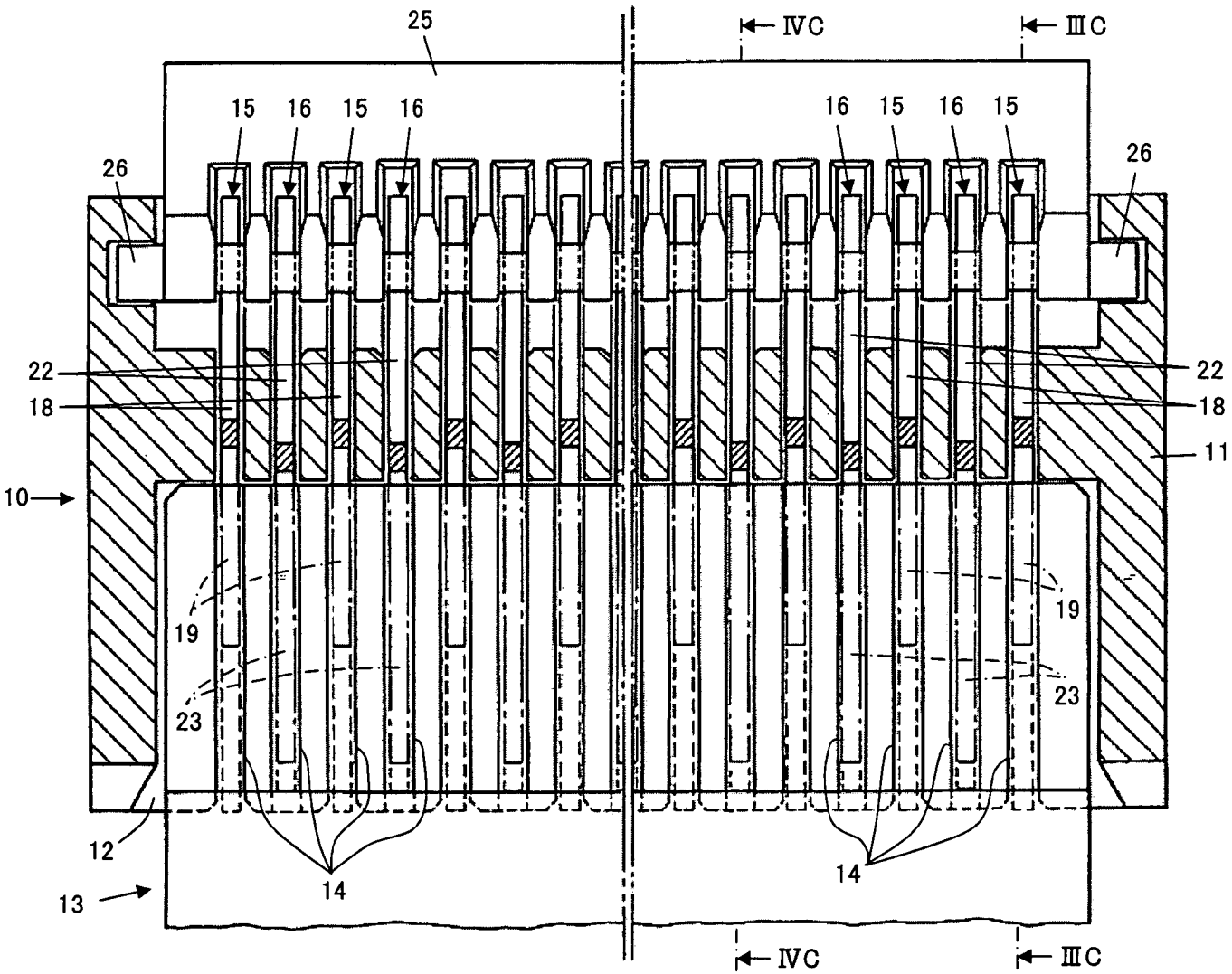
FIG. 10 is a schematic cross sectional view showing the first embodiment shown in FIGS. 1 and 2 into which the flexible printed circuit board shown in FIGS. 1 and 2 is partially inserted and in which the actuator has been rotated.

As explained above, when the part of the flexible printed circuit board 13 is inserted into the housing 11 through the opening 12 and the actuator 25 is postured to take up the second station, each of the conductive contacts 15 and 16 arranged alternately in the housing 11 is brought into press-contact with the corresponding one of the connecting terminals 14 provided on the part of the flexible printed circuit board 13, as shown in FIG. 10. A distance from an end of the connecting terminal 14 which corresponds to the conductive contact 15 to a portion of that connecting terminal 14 with which the conductive contact 15 comes into press-contact is different from a distance from an end of the connecting terminal 14 which corresponds to the conductive contact 16 to a portion of that connecting terminal 14 with which the conductive contact 16 comes into press-contact. In FIG. 10, the distance from the end of the connecting terminal 14 which corresponds to the conductive contact 15 to the portion of that connecting terminal 14 with which the conductive contact 15 comes into press-contact is shorter than the distance from the end of the connecting terminal 14 which corresponds to the conductive contact 16 to the portion of that connecting terminal 14 with which the conductive contact 16 comes into press-contact.

The actuator 25 postured to take up the second station, as shown in FIG. 10, is rotated to move from the second station toward the first station, as occasion demands. The rotation of the actuator 25 for moving from the second station toward the first station is opposite in direction to that for moving from the first station toward the second station.

The actuator 25 in the rotation for moving from the second station toward the first station operates to cause each of the conductive contacts 15 and 16 to get out of press-contact with the corresponding one of the connecting terminals 14 provided on the part of the flexible printed circuit board 13. In this operation, with the rotation of the actuator 25 from the second station toward the first station, each of the cams 27 provided on the actuator 25, which engages with the conducting contact 15 to bring the same into press-contact with the connecting terminal 14, operates to move the beam 19 of the conductive contact 15 so as to cause the end portion 19*a* of the beam 19 to get out of press-contact with the connecting terminal 14 and each of the cams 28 provided on the actuator 25, which engages with the conducting contact 16 to bring the same into press-contact with the connecting terminal 14, operates to move the beam 23 of the conductive contact 16 so as to cause the end portion 23*a* of the beam 23 to get out of press-contact with the connecting terminal 14.

Since the first direction of maximum dimension of each of the cams 27 is different from the second direction of maximum dimension of each of the cams 28, during the rotation of the actuator 25 to move from the second station toward the first station, a time point at which each of the conductive contacts 15 gets out of press-contact with the connecting terminal 14 is different from a time point at which each of the conductive contacts 16 gets out of press-contact with the connecting terminal 14, so that a time difference is brought about between both of the time points. For example, during the rotation of the actuator 25 to move from the second station toward the first station, first each of the conductive contacts 15 gets out of press-contact with the connecting terminal 14 and then each of the conductive contacts 16 gets out of press-contact with the connecting terminal 14.

In the above described electrical connector 10, which constitutes the first embodiment of electrical connector according to the present invention, with the rotation of the actuator 25 from the first station toward the second station, the time difference is brought about between the time point at which the conductive contacts 15 exert the maximum retroactive force on the actuator 25 and the time point at which the conductive contacts 16 exert the maximum retroactive force on the actuator 25 so that the time point at which the conductive contacts 15 exert the maximum retroactive force on the actuator 25 comes first and the time point at which the conductive contacts 16 exert the maximum retroactive force on the actuator 25 after that. That is, the maximum retroactive force from the conductive contacts 15 and the maximum retroactive force from the conductive contacts 16 do not act simultaneously on the actuator 25 but act respectively on the actuator 25 with the time difference.

Each of the maximum retroactive force from the conductive contacts 15 and the maximum retroactive force from the conductive contacts 16 is about a half of the amount of the maximum retroactive force from both of the conductive contacts 15 and 16. This means that the maximum retroactive force acting practically on the actuator 25 at the same time is reduced to be approximately a half of the amount of the retroactive force from both of the conductive contacts 15 and 16.

Accordingly, in the electrical connector 10 constituting the first embodiment of electrical connector according to the present invention, when the actuator 25 is rotated to bring each of the conductive contacts 15 and 16 into press-contact with the corresponding one of the connecting terminals 14 provided on the part of the flexible printed circuit board 13 which is inserted into the housing 11 through the opening 12, the maximum retroactive force from the conductive contacts 15 or 16 acting on the actuator 25 as reaction against the rotation of the actuator 25 is restrained to be relatively small. Therefore, a relatively small operational force which is able to overcome the maximum retroactive force from the conductive contacts 15 or 16 which is restrained to be relatively small is necessitated for rotating the actuator 25. As a result, with the electrical connector 10, the operational force necessary for rotating the actuator 25 is advantageously reduced, so that the actuator 25 is effectively prevented from being damaged with an excessive force acted thereon and improved in its operational easiness.

Although, during the rotation of the actuator 25 to move from the first station toward the second station, first each of the conductive contacts 15 is brought into press-contact with the corresponding one of the connecting terminal 14 and then each of the conductive contacts 16 is brought into press-contact with the corresponding one of the connecting terminal 14 in the first embodiment described above, it is also possible to set the conductive contacts 15 and 16 so that first each of the conductive contacts 16 is brought into press-contact with the corresponding one of the connecting terminal 14 and then each of the conductive contacts 15 is brought into press-contact with the corresponding one of the connecting terminal 14 when the actuator 25 is rotated to move from the first station toward the second station.

Further, it is not always necessary that the conductive contacts 15 and the conductive contacts 16 are arranged alternately in the housing 11.

In addition, although each of the conductive contacts 15 and each of the conductive contacts 16 are formed to be different in shape and dimension from each other in the first embodiment, it should be understood that each of the conductive contacts 15 and each of the conductive contacts 16 can be formed into the same shape and dimension.

Figure 11A:
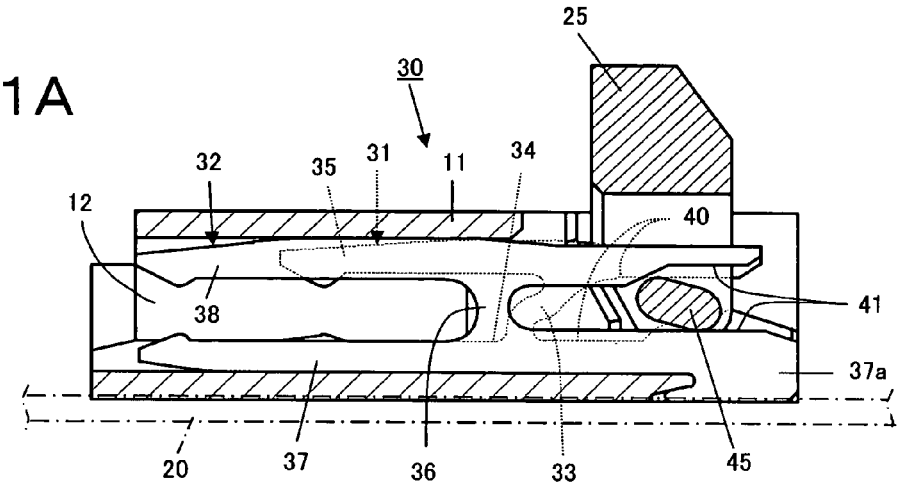
FIGS. 11A, 11B and 11C are a second embodiment of electrical connector according to the present invention, into which a part of a flexible printed circuit board is inserted.
Figure 11B:
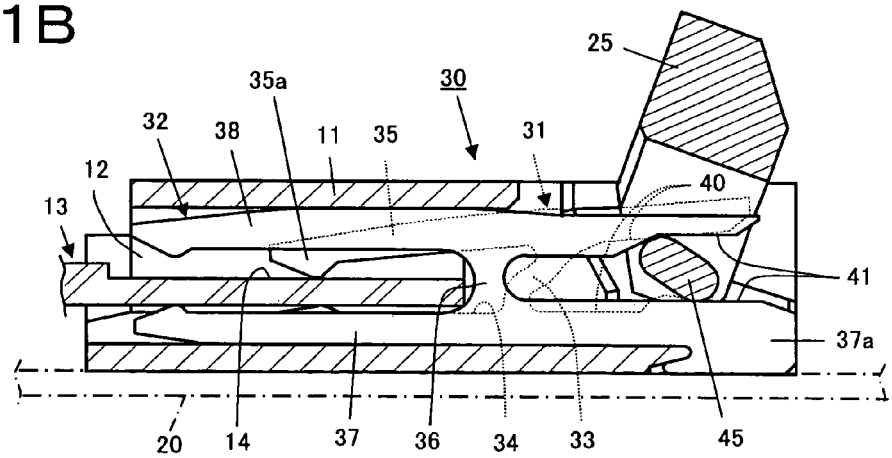
Figure 11C:
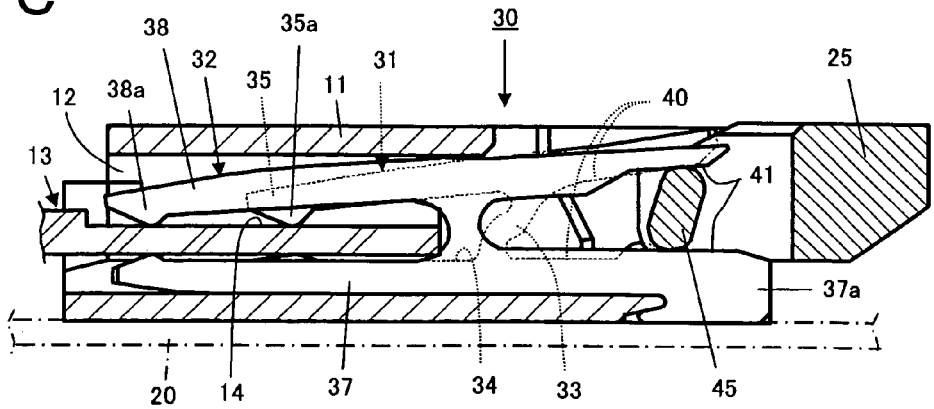

FIGS. 11A, 11B and 11C show a second embodiment of electrical connector according to the present invention, together with a part of a flexible printed circuit board inserted into the first embodiment.

Referring to FIGS. 11A to 11C, an electrical connector 30, which constitutes the second embodiment of electrical connector according to the present invention, has various parts and portions corresponding to those in the above described first embodiment shown in FIGS. 1 to 10, which are marked with the same references, and further description thereof will be omitted.

The electrical connector 30 is attached to a main circuit board 20 in the same manner as the electrical connector 10 shown in FIGS. 1 to 10. A part of a flexible printed circuit board 13 is inserted into a housing 11 of the electrical connector 30 through an opening 12 provided thereon. On the part of the flexible printed circuit board 13, which is inserted into the housing 11 through the opening 12, a plurality of connecting terminals 14 are provided to be arranged.

A plurality of conductive contacts 31 which correspond to the conductive contacts 15 in the electrical connector 10 aforementioned and a plurality of conductive contacts 32 which correspond to the conductive contacts 16 in the electrical connector 10 aforementioned are arranged alternately in the housing 11 of the electrical connector 30. Each of the conductive contacts 31 and 32 elongates in a direction along which the part of the flexible printed circuit board 13 is inserted into the housing 11 and drawn out of the housing 11 and is positioned to correspond to one of the connecting terminals 14 provided on the part of the flexible printed circuit board 13 when the flexible printed circuit board 13 is partially inserted into the housing 11 through the opening 12.

Each of the conductive contacts 31 is made of conductive resilient material and formed into an H-shaped plate member. The conductive contact 31 has a pair of beams 34 and 35 coupled with each other through a connecting portion 33. The beam 34 constitutes a fixed portion of the conductive contact 31 and the beam 35 constitutes a movable portion of the conductive contact 31 serving as an operating part of the conductive contact 31. An end portion of the beam 34 is electrically connected with a conducting circuit pattern portion provided on a main circuit board 20 on which the electrical connector 30. Illustrations of the end portion of the beam 34 and the conducting circuit pattern portion on the main circuit board 20 are omitted.

Each of the conductive contacts 32 is also made of conductive resilient material and formed into an H-shaped plate member. The conductive contact 32 has a pair of beams 37 and 38 coupled with each other through a connecting portion 36. The beam 37 constitutes a fixed portion of the conductive contact 32 and the beam 38 constitutes a movable portion of the conductive contact 32 serving as an operating part of the conductive contact 32. One end portion 37*a* of the beam 37 is electrically connected with a conducting circuit pattern portion provided on the main circuit board 20 on which the electrical connector 30 is mounted. An illustration of the conducting circuit pattern portion on the main circuit board 20 is omitted.

A part of the beam 34 and a part of the beam 35 of each of the conductive contacts 31, which are positioned to face each other at a side of the housing 11 opposite to another side of the housing 11 on which the opening 12 is provided, constitute an engaging portion 40 formed into a first predetermined shape. Hereinafter, the part of the beam 34 and the part of the beam 35 constituting the engaging portion 40 are referred to as a right-side portion of the beam 34 and a right-side portion of the beam 35, respectively. A part of the beam 37 and a part of the beam 38 of each of the conductive contacts 32, which are positioned to face each other at the side of the housing 11 opposite to the side of the housing 11 on which the opening 12 is provided, constitute an engaging portion 41 formed into a second predetermined shape different from the first predetermined shape. Hereinafter, the part of the beam 37 and the part of the beam 38 constituting the engaging portion 41 are referred to as a right-side portion of the beam 37 and a right-side portion of the beam 38, respectively.

The conductive contacts 31 and the conductive contacts 32 thus arranged alternately are divided into first and second groups. The first group is formed with the conductive contacts 31 and the second group is formed with the conductive contacts 32 in the same manner as the first group constituted with the conductive contacts 15 and the second group constituted with the conductive contacts 16 in the electrical connector 10 described above. That is, each of the conductive contacts 31 belongs to the first group and each of the conductive contacts 32 belongs to the second group.

When the flexible printed circuit board 13 is partially inserted into the housing 11 through the opening 12, the part of the flexible printed circuit board 13 on which the connecting terminals 14 are provided is placed between the beam 34 and the beam 35 of each of the conductive contacts 31 and between the beam 37 and the beam 38 of each of the conductive contacts 32. The connecting terminals 14 provided on part of the flexible printed circuit board 13 are positioned to correspond respectively to the conductive contacts 31 and 32 which are arranged alternately in the housing 11.

Further, as shown in FIGS. 11A to 11C, an actuator 25, which is attached rotatably to the housing 11 to be positioned at the side of the housing 11 opposite to the side of the housing 11 on which the opening 12 is provided, has a plurality of cams 45 corresponding to the conductive contacts 31 and 32, respectively. Each of the cams 45 has the same oval cross section. The oval cross section of the cam 45 has the maximum dimension measured across in a direction which varies with the rotation of the actuator 25. Hereinafter, this direction is referred to as a direction of maximum dimension. Each of the cams 45 has the same direction of maximum dimension.

The actuator 25 is postured to take up first and second stations selectively in the same manner as the actuator 25 in the electrical connector 10 aforementioned. In the first station, the actuator 25 keeps rising from the housing 11, as shown in FIG. 11A, and in the second station, the actuator 25 keeps lying down on the housing 11, as shown in FIG. 11C.

When the actuator is postured to take up the first station, as shown in FIG. 11A, each of a group of the cams 45 corresponding to the conductive contacts 31 engages with the engaging portion 40 of the conductive contact 31 by coming into contact with both of the right-side portion of the beam 34 and the right-side portion of the beam 35, each of another group of the cams 45 corresponding to the conductive contacts 32 engages with the engaging portion 41 of the conductive contact 32 by coming into contact with the right-side portion of the beam 37 and taking up a position apart from the right-side portion of the beam 38. In such a condition, each of the cams 45 does not move the beam 35 of the conductive contact 31 nor the beam 38 of the conductive contact 32.

Then, the cams 45 are rotated at the same time when the actuator 25 is rotated to move from the first station toward the second station, as shown in FIG. 11B. Thereby, each of the cams 45 corresponding to the conductive contacts 31 keeps the engagement with the engaging portion 40 of the conductive contact 31 by coming into contact with both of the right-side portion of the beam 34 and the right-side portion of the beam 35 and moves the beam 35 of the conductive contact 31 so that an end portion 35*a* of the beam 35 is brought into press-contact with one of the connecting terminals 14 provided on the part of the flexible printed circuit board 13. After that, each of the cams 45 engaging with the engaging portion 40 of the conductive contact 31 further moves the beam 35 of the conductive contact 31 with the rotation of the actuator 25 and causes the beam 35 of the conductive contact 31 to move at the maximum in response to the first predetermined shape of the engaging portion 40.

On the other hand, each of the cams 45 corresponding to the conductive contacts 32 shifts from the engagement with the engaging portion 41 of the conductive contact 32 by coming into contact with the right-side portion of the beam 37 and taking up a position apart from the right-side portion of the beam 38 to an engagement with the engaging portion 41 of the conductive contact 32 by coming into contact with both of the right-side portion of the beam 37 and the right-side portion of the beam 38 and moves the beam 38 of the conductive contact 32 with the rotation of the actuator 25.

Then, when the actuator 25 is further rotated and postured to take up the second station, as shown in FIG. 11C, each of the cams 45 engaging with the engaging portion 40 of the conductive contact 31 keeps the beam 35 of the conductive contact 31 bringing the end portion 35*a* thereof into press-contact with the connecting terminal 14 after the movement of the beam 35 at the maximum, and each of the cams 45 engaging with the engaging portion 41 of the conductive contact 32 moves the beam 38 of the conductive contact 32 at the maximum so that an end portion 38*a* of the beam 38 is brought into press-contact with one of the connecting terminals 14 provided on the part of the flexible printed circuit board 13.

In such a manner as mentioned above, when the flexible printed circuit board 13 is partially inserted into the housing 11 through the opening 12 and the actuator 25 having the cams 45 is rotated to move from the first station toward the second station, first each of the cams 45 engaging with the engaging portion 40 of the conductive contact 31 moves the beam 35 of the conductive contact 31 in response with the first predetermined shape of the engaging portion 40 so that the end portion 35*a* of the beam 35 is brought into press-contact with the connecting terminals 14 provided on the part of the flexible printed circuit board 13 inserted into the housing 11 and the beam 35 is caused to move at the maximum, and then each of the cams 45 engaging with the engaging portion 41 of the conductive contact 32 moves the beam 38 of the conductive contact 32 in response with the second predetermined shape of the engaging portion 41 so that the end portion 38*a* of the beam 38 is brought into press-contact with the connecting terminals 14 provided on the part of the flexible printed circuit board 13 inserted into the housing 11 and the beam 38 is caused to move at the maximum, In such operations, when each of the cams 45 engaging with the engaging portion 40 of the conductive contact 31 moves the beam 35 of the conductive contact 31 at the maximum, the maximum retroactive force from the beam 35 acts on the cam 45. Therefore, a time point at which each of the cams 45 engaging with the engaging portion 40 of the conductive contact 31 moves the beam 35 of the conductive contact 31 at the maximum is a time point at which the conductive contacts 31 exert the maximum retroactive force on the actuator 25. Similarly, when each of the cams 45 engaging with the engaging portion 41 of the conductive contact 32 moves the beam 38 of the conductive contact 32 at the maximum, the maximum retroactive force from the beam 38 acts on the cam 45. Therefore, a time point at which each of the cams 45 engaging with the engaging portion 41 of the conductive contact 32 moves the beam 38 of the conductive contact 32 at the maximum is a time point at which the conductive contacts 32 exert the maximum retroactive force on the actuator 25.

Under such a situation, with the movement of the actuator 25 from the first station toward the second station, each of the cams 45 provided on the actuator 25 operates to move first the beam 35 of the conductive contact 31 at the maximum and then the beam 38 of the conductive contact 32 at the maximum. Accordingly, a time difference is brought about between the time point at which the conductive contacts 31 exert the maximum retroactive force on the actuator 25, which is the same as the time point at which each of the cams 45 provided on the actuator 25 operates to move the beam 35 of the conductive contact 31 at the maximum, and the time point at which the conductive contacts 32 exert the maximum retroactive force on the actuator 25, which is the same as the time point at which each of the cams 45 provided on the actuator 25 operates to move the beam 38 of the conductive contact 32 at the maximum. That is, the time point at which the conductive contacts 31 exert the maximum retroactive force on the actuator 25 comes first and the time point at which the conductive contacts 32 exert the maximum retroactive force on the actuator 25 comes after that.

As described above, during the movement of the actuator 25 from the first station toward the second station for causing the cams 45 provided on the actuator 25 to bring the conductive contacts 31 and 32 into press-contact with the connecting terminals 14 provided on the part of the flexible printed circuit board 13, the actuator 25 operates to cause each of the cams 45 corresponding to the conductive contacts 31 belongs to the first group to engage with each of the conductive contacts 31 in a first predetermined manner and each of the cams 45 corresponding to the conductive contacts 32 belongs to the second group to engage with each of the conductive contacts 32 in a second predetermined manner different from the first manner so that the time difference is brought about between the time point at which the conductive contacts 31 put in press-contact with the connecting terminals 14 exert the maximum retroactive force on the actuator 25 and the time point at which the conductive contacts 32 put in press-contact with the connecting terminals 14 exert the maximum retroactive force on the actuator 25.

The actuator 25 postured to take up the second station, as shown in FIG. 11C, is rotated to move from the second station toward the first station, as occasion demands. The rotation of the actuator 25 for moving from the second station toward the first station is opposite in direction to that for moving from the first station toward the second station.

The actuator 25 in the rotation for moving from the second station toward the first station operates to cause each of the conductive contacts 31 and 32 to get out of press-contact with the corresponding one of the connecting terminals 14 provided on the part of the flexible printed circuit board 13. In this operation, with the rotation of the actuator 25 from the second station toward the first station, each of the cams 45 engaging with the engaging portion 40 of the conducting contact 31 to bring the conducting contact 31 into press-contact with the connecting terminal 14 operates to move the beam 35 of the conductive contact 31 so as to cause the end portion 35*a* of the beam 35 to get out of press-contact with the connecting terminal 14, and each of the cams 45 engaging with the engaging portion 41 of the conducting contact 32 to bring the conducting contact 32 into press-contact with the connecting terminal 14 operates to move the beam 38 of the conductive contact 32 so as to cause the end portion 38*a* of the beam 38 to get out of press-contact with the connecting terminal 14.

With the electrical connector 30 which constitutes the second embodiment of electrical connector according to the present invention, operative effect and advantages which are the same as those obtained with the electrical connector 10 constituting the first embodiment of electrical connector according to the present invention can be obtained. Further, in the electrical connector 30, the manner of press-contact of the conductive contacts 31 and 32 with the connecting terminals 14, the arrangement of the conductive contacts 31 and 32, the shape and dimension of each of the conductive contacts 31 and 32 and so on are treated in the same manner as those in the electrical connector 10.

Although the conductive contacts 15 and 16 in the electrical connector 10 which constitutes the first embodiment of electrical connector according to the present invention are divided into the first and second groups and the conductive contacts 31 and 32 in the electrical connector 30 which constitutes the second embodiment of electrical connector according to the present invention are also divided into the first and second groups, it should be understood that the electrical connector according to the present invention is not limited to such first and second embodiments. For example, it is possible to arrange a plurality of conductive contacts to be divided into N groups (N is an integer more than two) in a housing of the electrical connector according to the present invention. In the case where the conductive contacts are divided into N groups, an actuator attached rotatably to the housing operates to engage with each of the conductive contacts belonging to one of N groups for bringing the same into press-contact with one of connecting terminals on a part of a circuit board inserted into the housing in a first predetermined manner and with each of the conductive contacts belonging to another of N groups for bringing the same into press-contact with one of the connecting terminals in a second predetermined manner different from the first predetermined manner so that a time difference is brought about between a time point at which the conductive contacts belonging to one of N groups exert the maximum retroactive force on the actuator and a time point at which the conductive contacts belonging to another of N groups exert the maximum retroactive force on the actuator 25.

What is claimed is:

1. An electrical connector comprising;

a housing made of insulator and provided with an opening through which a circuit board is partially inserted into the housing, a plurality of conductive contacts arranged in the housing, each of said conductive contacts being positioned to correspond to one of a plurality of connecting terminals provided on the circuit board when the circuit board is partially inserted into the housing through the opening provided thereon, and an actuator attached rotatably to the housing to engage with the conductive contacts and to take up first and second stations selectively, said actuator being operative to bring each of the conductive contacts into press-contact with one of the connecting terminals corresponding thereto when the circuit board is partially inserted into the housing through the opening provided thereon and the actuator is shifted from the first station to the second station and to cause each of the conductive contacts to get out of press-contact with the corresponding one of the connecting terminals when the circuit board is partially inserted into the housing through the opening provided thereon and the actuator is shifted from the second station to the first station, wherein said conductive contacts provided in the housing are divided into at least first and second groups, and said actuator engages with each of the conductive contacts belonging to the first group for bringing the same into press-contact with the corresponding connecting terminal in a first predetermined manner and with each of the conductive contacts belonging to the second group for bringing the same into press-contact with the corresponding connecting terminal in a second predetermined manner different from the first predetermined manner so that a time difference is brought about between a first time point at which the conductive contacts belonging to the first group kept in press-contact with the connecting terminals exert the maximum retroactive force to the actuator and a second time point at which the conductive contacts belonging to the second group kept in press-contact with the connecting terminals exert the maximum retroactive force to the actuator.

2. An electrical connector according to claim 1, wherein the actuator has a plurality of cams each engaging with one of the conductive contacts in the housing and operative to move a movable portion of the conductive contact to come into press-contact with the connecting terminal provided on the circuit board which is partially inserted into the housing through the opening provided thereon, and with the operation of the cams, the actuator operates to bring each of the conductive contacts belonging to the first group into press-contact with the corresponding connecting terminal in the first predetermined manner and each of the conductive contacts belonging to the second group into press-contact with the corresponding connecting terminal in the second predetermined manner different from the first predetermined manner.

3. An electrical connector according to claim 2, wherein each of the cams has a specific portion of the maximum dimension measured across in its cross section moving with a rotation of the actuator, the conductive contact exerts the maximum retroactive force on the cam when the specific portion of the cam acts on the movable portion of the conductive contact, and during the rotation of the actuator for moving from the first station toward the second station, a time point at which the specific portion of each of the cams corresponding to the conductive contacts belonging to the first group acts on the movable portion of the conductive contact belonging to the first group is different from a time point at which the specific portion of each of the cams corresponding to the conductive contacts belonging to the second group acts on the movable portion of the conductive contact belonging to the second group.

4. An electrical connector according to claim 2, wherein each of the cams engages with an engaging portion of each of the conductive contacts for moving a movable portion of the conductive contact at the maximum with a rotation of the actuator, the conductive contact exerts the maximum retroactive force on the cam when the cam moves the movable portion of the conductive contact at the maximum, and during the rotation of the actuator for moving from the first station toward the second station, a time point at which each of the cams corresponding to the conductive contacts belonging to the first group moves the movable portion of the conductive contact at the maximum is different from a time point at which each of the cams corresponding to the conductive contacts belonging to the second group moves the movable portion of the conductive contact at the maximum.

5. An electrical connector according to claim 1, wherein the conductive contacts belongs to the first group and the conductive contacts belongs to the second group are arranged alternately in the housing.

6. An electrical connector according to claim 5, wherein a distance from an end of a first connecting terminal which corresponds to the conductive contact belonging to the first group to a portion of the first connecting terminal with which the conductive contact comes into press-contact is different from a distance from an end of a second connecting terminal which corresponds to the conductive contact belonging to the second group to a portion of the second connecting terminal with which the conductive contact comes into press-contact.

7. An electrical connector according to claim 1, wherein the actuator is positioned at a side of the housing opposite to another side of the housing on which the opening is provided.

* * * * *